United States Patent [19]

Messner

[11] Patent Number: 4,916,951

[45] Date of Patent: Apr. 17, 1990

[54] A PRESS, HAVING A SUBSTRUCTURE WITH VERTICAL SPRING SUPPORTS

[75] Inventor: Helmut Messner, Arbon, Switzerland

[73] Assignee: Bruderer AG, Switzerland

[21] Appl. No.: 117,748

[22] Filed: Nov. 4, 1987

[30] Foreign Application Priority Data

Nov. 4, 1986 [CH] Switzerland ..... 4366/86

[51] Int. Cl.[4] ..... B21D 37/12

[52] U.S. Cl. ..... 72/455; 72/448

[58] Field of Search ..... 72/446, 448, 455, 456, 72/481; 100/257, 918, 214

[56] References Cited

U.S. PATENT DOCUMENTS

| | | | |
|---|---|---|---|
| 3,111,100 | 11/1963 | Georgeff | 72/455 X |
| 4,553,795 | 11/1985 | Takagi | 100/918 X |

FOREIGN PATENT DOCUMENTS

| | | | |
|---|---|---|---|
| 2642538 | 3/1978 | Fed. Rep. of Germany | 72/455 |
| 2740042 | 3/1979 | Fed. Rep. of Germany . | |
| 57-39043 | 3/1982 | Japan | 72/456 |
| 175355 | 1/1963 | U.S.S.R. . | |
| 574254 | 9/1977 | U.S.S.R. | 72/481 |
| 725901 | 4/1980 | U.S.S.R. | 72/448 |
| 1013306A | 4/1983 | U.S.S R. . | |

OTHER PUBLICATIONS

VDI-ZEITSCHRIFT, Band 125, Nr. 11, Juni 1983, Seiten 449–454, Dusseldorf, DE; W. HELLWIG.

WERKSTATTSTECHNIK, ZEITSCHRIF FUR INDUSTRIELLE FERTIGUNG, Band 73, Nr. 6, Juni 1983, Seiten 371–372, Berlin, DE.

MACHINERY AND PRODUCTION ENGINEERING BAND, 143, Nr. 3667, Murz 1985, Seite 81, Horton Kirby, Kent, GB.

DE-A-2 740 042 (PELTZER & EHLERS) SEITEN 20–24, 34–39; Figuren 1,3,4.

*Primary Examiner*—E. Michael Combs

*Attorney, Agent, or Firm*—Ostrolenk, Faber, Gerb & Soffen

[57] ABSTRACT

A press, in particular a high-speed punch press (1), has a substructure (7) which is elastically mounted by means of springs (14). This makes it possible for the press (1) to assume various heights depending on the applied weight (for example that of the tool). In order to ensure cooperation with a handling device (31) of as simple a design as possible, a locking means (42) is provided, by means of which the substructure (7) can be fixed at a predetermined height.

14 Claims, 7 Drawing Sheets

A PRESS, HAVING A SUBSTRUCTURE WITH VERTICAL SPRING SUPPORTS

BACKGROUND OF THE INVENTION

The invention relates to a press having vertical spring supports for resiliently supporting the die-bearing portion of its frame.

Presses of this type are frequently in the form of high-speed punch presses or high-speed presses performing several hundred to more than two thousand punching operations per minute. Of course, other presses too can be mounted in this manner in order to avoid vibrations. Today, such presses represent a very high level of efficiency, their operation being substantially automated.

In considering how it might be possible to achieve further automation in the feeding and removal of parts, it was found that this mount, which provides very good damping during operation, has disadvantages for these purposes in that, depending on the weight on the machine, its height may differ. Particularly when handling devices are to be used, it is no longer possible to manage with rigid programming of the various positions of these handling devices. It is true that there are robots, as handling devices, which are capable of automatically selecting the relevant position with the aid of sensors, but these are not only relatively expensive but also liable to require repair. Such problems do of course also occur in conventional conveying means but are easier to overcome.

German Offenlegungsschrift 2,740,042 as published Mar. 8, 1979, describes a tool change means for a machine, on which the individual processing steps are effected by means of independent tool inserts which are also fastened independently of one another. There must be separate operation steps for changing each of the individual tool inserts, for the die and for the punch.

In the German Offenlegungsschrift mentioned, height adjustment and locking of the tool changing means is one of the necessary steps in the sequence of movements during a tool-changing process. Once again, adjustment to correspond to various positions of the press which are reached because of being supported by spring force could only be achieved with the aid of sensors or the like.

SUMMARY OF THE INVENTION

The object of the invention is to design a press having vertical spring supports for resiliently supporting the die-bearing portion of its frame, in such a way that, on the one hand, optimum mounting for operation is ensured and, on the other hand, the feed and removal of parts are simplified. In particular, the cooperation of the press with the handling device, especially for handling punching tools weighing several hundred kilograms, is to be simplified to such an extent that an uncomplicated and therefore cheap but reliable manipulation device can be used.

This object is achieved by providing this press with a locking means for the spring-mounted substructure for fixing the latter at a predetermined height, for example in line with a handling device. This makes it possible to use the elastic mount when the press is in operation, whereas the locking means comes into effect during operation of the handling device, i.e. when the press is switched off. This can easily be automated so that the locking means is switched on automatically when the press is switched off.

For better adaptation, in particular to various handling devices (for example if a handling device is changed), it is advantageous to provide a stop for determining the predetermined height, and preferably adjusting means for the stop.

If the stop has oblique centering surfaces, and preferably appropriately shaped counter-surfaces opposite thereto, it is easy to provide this centering stop at a point which is a (long) distance away from the locking means, in order to counteract the production of moments of load and to provide a rigid frame in the locked position.

The locking means could of course also be operated by hand, but, in view of the automation desired, it is advantageous if the locking means has an actuating drive, preferably fluid-actuated, e.g., a hydraulic drive.

As will be evident from the description, the elastically mounted substructure need not necessarily be the stand for the entire press; instead, parts connected to it can also be elastically mounted, in particular in order to damp the punching impacts.

Further details are given in the following description of embodiments shown schematically in the drawing.

BRIEF DESCRIPTION OF THE DRAWINGS

FIG. 2*a* shows the right leg of the substructure, which leg is shown in FIG. 1, on a larger scale in order to illustrate an embodiment, of which

FIGS. 2*a'* and 2*b'* are magnified sections from FIG. 1 and FIG. 3*a*, respectively, but in modified form;

DETAILED DESCRIPTION

Figure 1:
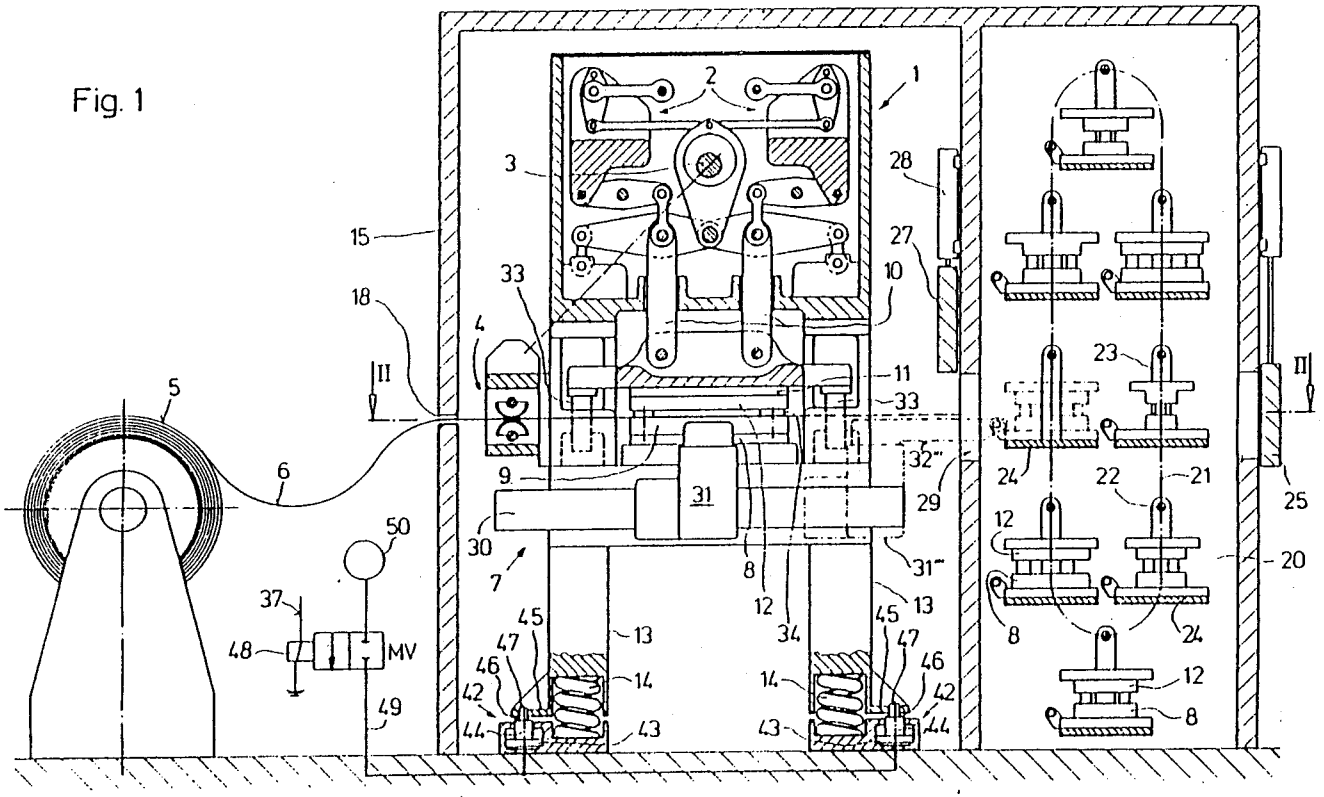
FIG. 1 shows a longitudinal section through the sound-insulating housing of a high-speed press, together with a connected tool receiver, along the line I—I of FIG. 2, parts of the press and of the receiver likewise being cut away and a handling device on the press, with its sliding guide, being shown.
Figure 2:
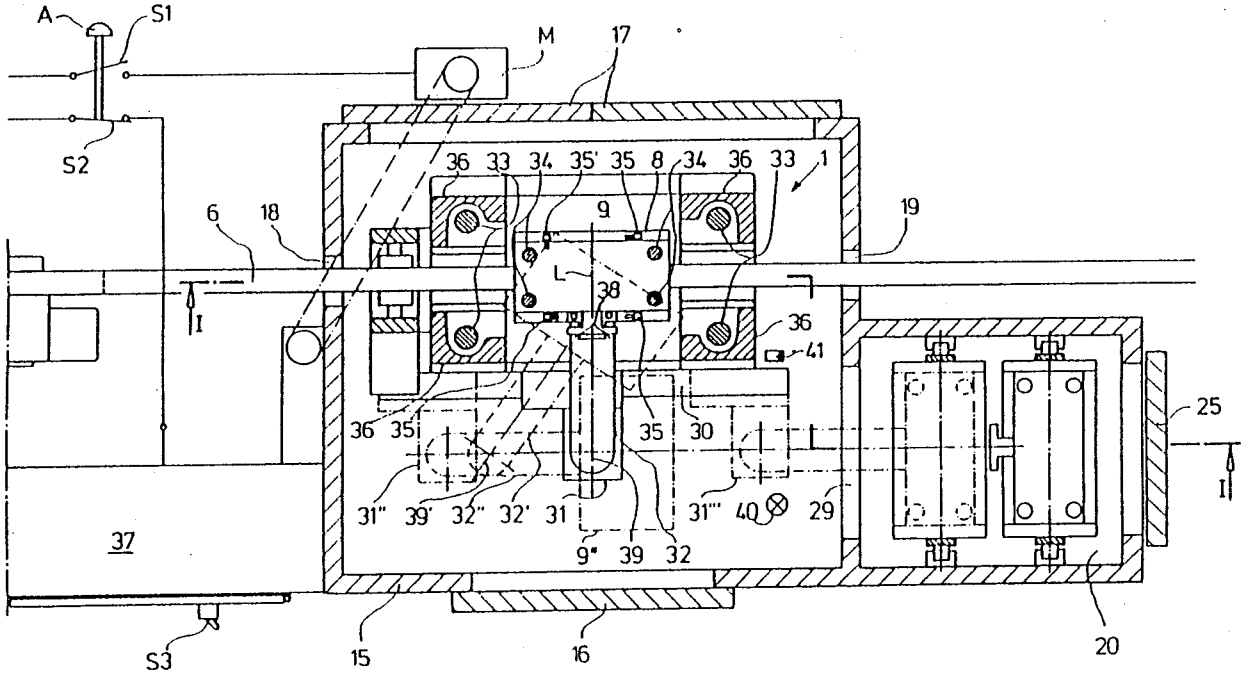
FIG. 2 is a cross-section through the sound-insulating housing according to FIG. 1, along the line II—II, parts of the press being cut away in order to illustrate the mode of operation of the handling device during tool change.

FIGS. 1 and 2 show a high-speed punch press 1 to which the invention is preferably applied because the high production rate in such presses necessitates a faster tool change and therefore presents a problem in this respect. The press can be recognized as a high-speed punch press in that counterweights 2 are connected to an eccentric drive 3 which also drives a feed drive 4 for the punch sheet 6 rolled on a coil 5, as indicated by the dash-dot line in FIG. 2. According to the diagram, the counterweights 2 are arranged as already described in U.S.-A No. 4 156 387, but any other arrangement can of course also be used for this purpose.

The punch press 1 rests on a substructure 7, on which a holding apparatus 8 for a stationary punch tool 9 is mounted. By means of the eccentric drive 3, a movable holding apparatus 11 to which a movable counter-tool 12 is attached is moved up and down in the vertical direction via slides 10. Of course, only the relative movement of the two tools 9, 12 is important, and it is just as possible for the upper one to be stationary and the lower one movable, as well as for both to be designed so that they are movable. Furthermore, although the vertical arrangement is preferred because the shocks produced by the punch press 1 are conducted away into the floor, the invention is not restricted to this.

Since these shocks are very strong in high-speed punch presses, the substructure 7 is generally elastically mounted. For this purpose, supporting springs 14 are incorporated in the four legs 13 of the substructure 7 (only two are visible in FIG. 1). The function of this spring system for the purposes of the invention will be explained below.

The punch press 1 is expediently accommodated in a sound-insulating housing 15, which is accessible from the rear through a door 16 (FIG. 2) and can be reached from the front through an entrance 17. The punch sheet 6 enters and emerges via narrow openings 18 and 19 respectively. Incidentally, FIG. 2 also shows the motor M which operates drives 3 and 4.

The parts described so far are present on a conventional high-speed punch press. Of course, the invention is in no way restricted only to such presses but is preferably applied to them because it is here that the problems to be resolved by the invention, arising from the high production rate, the rapid shock-like movement and the small amount of space in a sound-insulated housing 15, are particularly pronounced.

Precisely because of the high production rate, it is necessary to change the tools 9, 12 frequently if it is intended to use such a press 1 to produce even smaller numbers of pieces all at once. If tool change presents problems, as was the case in the past, the tools attached to the holding apparatuses 8, 11 (which incidentally may be of any known design) have to be used to produce a large number of pieces, which can only be delivered to the customer gradually, and this incurs storage costs in the meantime and ties up the capital invested.

For this reason, a tool magazine is located in an adjacent compartment 20 of the insulating housing 15, in which magazine a very wide variety of tools 9 and counter-tools 12 are placed one on top of the other on a continuous chain 21 (only indicated schematically in FIG. 1) on axles 22 and on pallets 24 suspended on the said axles by means of support levers 23.

Inside the compartment 20 for storing tools, a heating unit (not shown) can be provided in order to keep the tools 9, 12 constantly at the working temperature, since the precision can be adversely affected during the punching process even by relatively small temperature differences. For this reason, compartment 20 is expediently closed on all sides and insulated, access being possible from the outside through a sliding door 25 which can be moved, for example, by a cylinder unit 26. Analogously, a door 27 which opens onto punch press 1 and has a cylinder unit 28 is provided, the said door closing an opening 29.

In order to permit the very heavy tools 9, 12 to be changed easily and rapidly, a bearing element 30 for mounting a handling device 31 is fastened to the substructure 7 of the press 1. The handling device 31 possesses a gripping arm 32 shown in FIG. 2, by means of which at least one tool 9 or 12 can be moved from the punch press as soon as it has been detached from its holding apparatus 8 or 11. In this context, it is necessary to describe a few special features of such tools.

The movable holding apparatus 11 is provided at the sides with four guide columns 33 which are attached to it and move with it; furthermore, guide columns 34 are provided on the tools 8, 12. When the press 1 is in operation, the particular tool 9 or 12 is held firmly on its holding apparatus 8 or 11 with the aid of a detachable fastening means, for example by rotatable clamping jaws 35, three of which in FIG. 2 are shown in the unclamped state, i.e. rotated away from the tool 9, whereas clamping jaw 35' still grips and firmly holds the tool 9.

Since both tools 9, 12 are to be removed together, the handling device can grip both of them together, together with the columns 34, and then (after opening the clamping jaws 35) has to transport them out of the restricted space between the substructure parts 36 surrounding the guide columns 33. This would be possible per se if the front end of the gripping arm were moved about two joints in the arm in such a way that it moved at least approximately along a straight line. Thus, the gripping arm would have to be divided into two parts by a joint and moreover, at its end which faces the bearing element 30, would have to rotate about a further joint.

It is advantageous to provide at least one sliding guide. This may be a telescopic guide or a guide as described below with reference to FIGS. 3*a* and 4*a* preferably, however, the bearing element 30 itself is in the form of a sliding guide. Referring especially to FIG. 2, the handling device 31 is designed so that it is displaceable along this sliding guide 30, parallel to the plane of the holding apparatus 8, 11 and at right angles to the direction of movement of the movable tool 12 and its holding apparatus 11. To permit the bearing element 30 to rest on the substructure 7, its center of gravity is relatively low when the punch simultaneously operates with a vertical direction of movement. On the other hand, mounting on the substructure 7 makes it possible for the floor underneath the device 31 to be kept free so that an operator can approach the press 1 sufficiently closely.

Figure 3A:
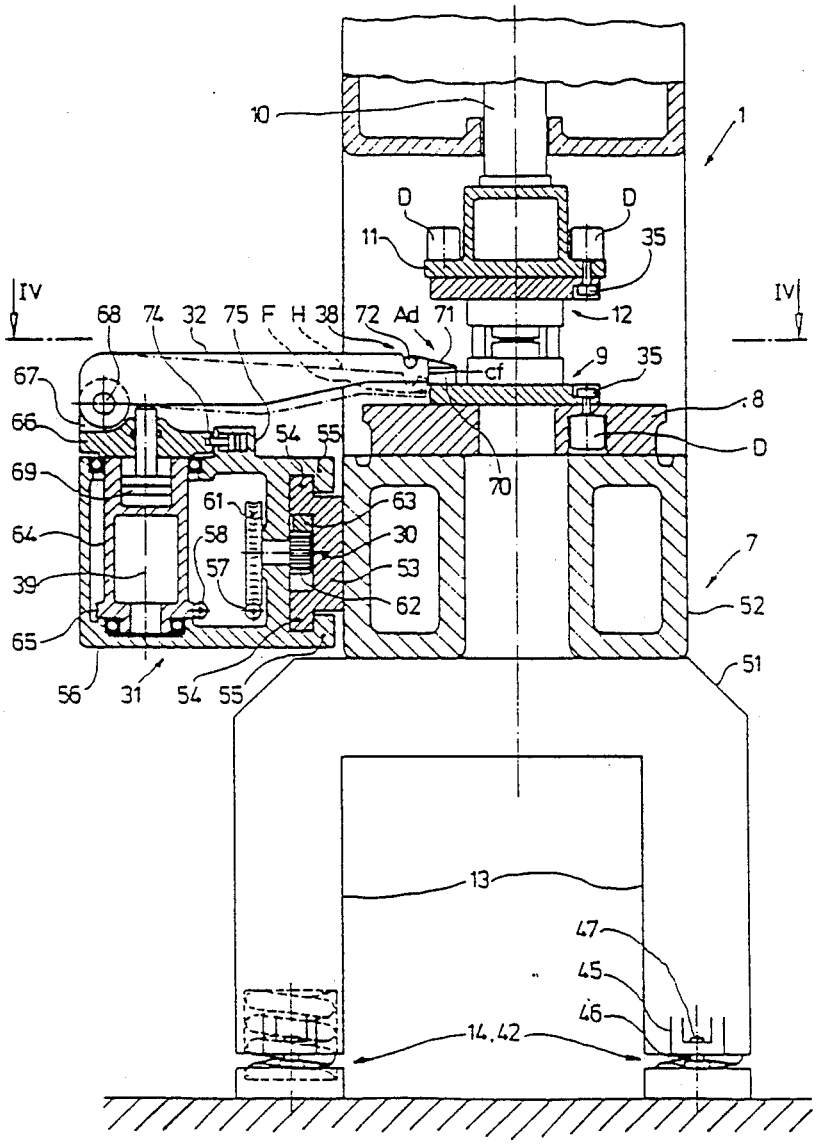
FIG. 3*a* is a cross-section through the press.
Figure 4A:
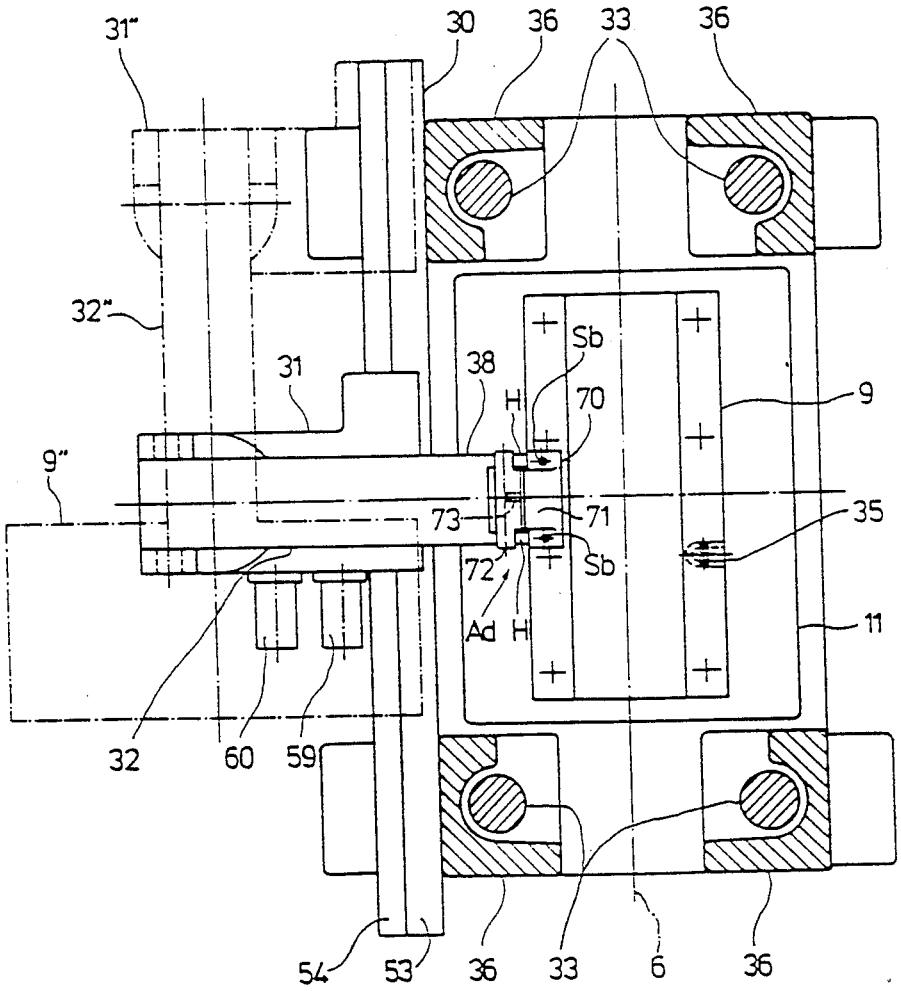
FIG. 4*a* is a section along the line IV—IV of FIG. 3*a*.

The handling device 31 is designed so that it can be displaced along such a sliding guide 30, as shown in the Figures, by means of a built-in motor or with the aid of a spindle (similar to a lathe) running along the sliding guide 30, the gripping arm 32 of the said handling device being rotatable, in the manner shown in FIG. 2, by a further drive likewise illustrated in FIGS. 3*a* and 4*a*. With the aid of such a sliding guide 30, it is possible to assign these two drives a common control unit, for example with a microprocessor, in a control cabinet 37 (cf. FIG. 2), which controls the sliding movements of the handling device 31 and the swivel movements of its gripping arm 32 in the manner described below with reference to FIG. 2.

FIG. 2 shows, by means of solid lines, the position assumed by the handling device 31 during operation of the press 1, when the handling device itself is at rest. It is important that the handling device is not switched on during operation of the press 1. It is therefore expedient to provide an appropriate security means. This can be achieved, for example, if the handling device can only be switched on by pressing two switch buttons, in order to prevent accidental switching on in a manner similar to that used for switching recording heads in tape recorders. In another possible method, mutual mechanical or electrical locking of the switches is provided. This can most simply be effected in the manner shown in FIG. 2, where a main switch S1 for the press motor M is connected via a single actuating element A to a ready switch S2 for the program control 37 of the handling device 31 in such a way that when one switch is switched on the other switch is switched off simultaneously (or as shown in FIG. 2, the switch S2 is opened before the switch S1 closes).

As soon as the switches S1, S2 are in the position shown in FIG. 2, the handling device 31 can be put into operation, expediently via a further switch S3 in series with switch S2. It has been found that the rest position of the handling device, indicated by solid lines, fulfills a dual purpose. Because the gripping arm 32 faces into the press during operation of the press 1, and lies predominantly or completely within the common contour lines formed by the contour lines of the press and of the handling device, it is ensured that the gripping arm 32 is not subjected to strong moments by vibration of the press 1, which would be the case if it were to project, for example toward the opposite side (i.e. downward as seen in FIG. 2).

Another advantage is that, as a result, the loading of the elastic mount 14 (cf. FIG. 1) is more uniform, which is important for effective damping, because the handling device 31 in any case results in additional weight acting on the two substructure legs 13 facing this device, so that it may be expedient to make the springs 14 stronger there than on the side which faces the entrance 17. Finally, the rest position described ensures that the handling device can begin to operate immediately after it is switched on, without first having to be brought to the tool 9 or 12. After the handling device 31 has been switched on, a coordinated movement of the sliding drive and of the swivel drive begins, this movement being such that the gripper 38 provided on the end of the gripping arm 32 moves within a path extending approximately along a straight line L (with the slight deviations shown in FIG. 2). Thus, the swivel axle 39 of the gripping arm 32 is displaced along the sliding guide 30 to the position 39', while the gripping arm 32 swivels to the position 32', so that the tool 9 which it grips remains on the line L, exactly in the middle between the substructure parts 36. Thus, in spite of cramped conditions and a very simple and robust construction of the handling device, the tool 9 or 12 can be pulled out or lifted out. At the end of the movement, the tool 9 is in a tool-removal position 9'', while the handling device 31 has reached position 31'' along the sliding guide 30, and the gripping arm assumes the position 32''.

Here, it can be seen that the arrangement of the tool magazine in compartment 20 is optimum in that the gripping arm 32 in the tool-removal position 32'' is parallel to the sliding guide 30, so that, on the one hand, the tool 9 can pass close to the substructure legs 36 for positioning and, on the other hand, the tool furthermore does not project to such an extent beyond the press stand that it hinders operators or even requires an extension of the sound-insulating housing 15.

The control required for coordinating these movements is a program control of any type which is known per se. If the control is a step control, the range can be found with a minimum number of position transducers, since each position depends on the number of steps from the start of the program.

Hence, if in the course of operation the handling device is driven from the tool-removal position 31'' to the right (based on FIG. 2) along the sliding guide 30, it finally reaches a tool transfer position 31'''. However, the orifice 29 must be opened beforehand, i.e. the door 27 must be moved to the position shown in FIG. 1. For this purpose, the cylinder unit control can be coupled with the step control, so that, in the step, the handling device 31 assumes a position in which the tool is just in front of the door 27 and at the same time the door 27 is opened. However, it is also possible for a position transducer, for example having a light source 40 and a photodetector 41, to be assigned to a control for the door 27, which is separate from the control 37, the door 27 being opened when the tool 9, the gripping arm 32 or the body of the handling device 31 passes through the beam of the light source 40.

The tool magazine inside compartment 20 is expediently in the form of a lift control, so that the pallets 24 always assume predetermined positions and the tool is thus reliably positioned on it (cf. the tool transfer position in FIG. 1). If particularly heavy tools weighing up to one metric ton are to be moved, the spring system 14 may constitute a critical source of problems. On the other hand, it is important that the handling device itself is not subjected to excessively great shocks, and it is for this reason that the elastic mounting is also expedient when the press in question is not a high-speed punch press; the elastic mounting can be provided between the substructure 7 and the bearing element 30. The problem therefore arises as to how it is possible on the one hand to provide an elastic mounting and on the other hand to avoid its potential disadvantageous effects if it is in fact necessary to handle such heavy tools.

The solution may be the locking means shown in FIG. 1, which is in the form of a balance locking system and, if desired, prevents an (elastic) movement of the substructure and hence of the bearing element 30 together with handling device 31 and provides securing so that the gripping arm 32 always assumes the transfer position 32''' at a height which corresponds to the position of a pallet 24.

The locking means may be designed so that cylinder units 42 are provided between the floor and the legs 13 of the substructure 7 which are elastically held by the springs 14, the pistons 43 of the said cylinder units assuming the position shown in FIG. 1 during operation of the press 1. Cylinder units 42 of this type can be provided on two legs 13 only on the side facing the handling device 31, or on all legs of the substructure 7. Each piston 43 has a piston rod 44 which, outside the cylinder 42, has a supporting surface 46 which is directed toward an extension 45 of the associated substructure leg 13 and from which, expediently (but not necessarily), a guide pin 47 projects upward and passes through a guide orifice in extension 45. If the press 1 is switched off by opening switch S1 (FIG. 2), and switch S2 is closed, the solenoid of a solenoid valve MV can be energized by control device 37 immediately or (preferably) only after switch S3 has been switched on. In the position of solenoid valve MV shown, a line 49 intended to connect the cylinder units 42 to a pressure medium source 50 is interrupted. If, on the other hand, the solenoid valve moves to the right (based on FIG. 1), the pressure medium source 50 is connected, with the result that the pistons 43 move upward. Their supporting surfaces 46 then rest against the underneath of the extension 45 and thus directly support the legs 13, so that the springs 14 are relaxed. This locks the legs 13, which can no longer execute any elastic movement, the height of the transfer position 32''' of the gripping arm 32 being fixed.

It should be mentioned here that this locking means 42 is would also be advantageous if the gripper mechanism were not mounted directly on the substructure 7 by means of the sliding guide 30 but rather, for example, if the rotational axis 39 of the gripper, which axis is shown in FIG. 3*a*, were mounted on a substructure standing adjacent to the press, so that the gripper would not be mechanically connected to the press. The reason for this will be explained subsequently with reference to FIG. 3*a*.

From FIGS. 3*a* and 4*a*, it can be seen that the substructure 7 of FIG. 1 consists of a frame 51, provided with legs 13, and a bearing block 52. The drives D arranged in the holding apparatus 8 or 11 and intended for the clamping jaws 35 (shown here engaging recesses in the tool) are also illustrated, although only one of these clamping jaws is shown in each case.

Furthermore, it can be seen that the bearing element 30 is in the form of a T guide and that T-shaped extensions 54 therefore project upward and downward from a fastening element 53 connected to the bearing block 52. These extensions 54 are encompassed by guide projections 55 of the handling device 31. The projections 55 project from a housing 56 in which the drive parts of the handling device 31 are housed. Although, for the sake of simplicity, a sliding guide system 54, 55 is shown here, rollers can, if desired, be provided on individual surfaces.

For the displacement drive of the handling device for movement along the sliding guide 30 (see the above description for FIGS. 1 and 2), the housing 56 may contain its own motor, in which case, however, it must be provided with its own power supply cable. It is more advantageous to drive a continuous spindle in the form of a lathe by means of a stationary motor. Such a spindle could be the spindle 57 (FIG. 3*a*). On the other hand, this spindle 57 and a similar spindle 58 may each be driven by a drive unit 59 or 60, respectively (FIG. 4*a*).

The spindle 57 engages a gear wheel 61 which is mounted in housing 56 and on whose axle a pinion 62 engages a toothed rack 63 provided on the sliding guide 30. Thus, the displacement is produced by driving in this manner.

To achieve the swivel movement described above, about the swivel axis 39 (cf. FIG. 2), a hollow shaft 64 is provided which possesses, at its lower end, a gear wheel 65 which engages the spindle 58. At its upper end, the hollow shaft 64 carries a rotary table 66, which is provided with bearing plates 67 for holding a swivel axle 68 running in the plane of the holding apparatuses 8, 11 are parallel to these. Thus, the gripping arm 32 can be swivelled upward and downward about the axle 39 on the one hand and about the horizontal axle 68 on the other. To achieve this upward and downward movement, a piston 69 is displaceable inside the hollow shaft 64, pressure medium from a pressure source, for example the source 50 (FIG. 1) being fed, in a manner which is not shown, to the said piston, under control by the controller 37.

In addition to these drives, one or more drives for the gripper 38 itself are frequently also provided in conventional handling devices, which—in a conventional embodiment—would necessitate very heavy gripper claws. For this reason, a different path has been pursued here.

To save the tool manufacturer the trouble of having to produce special gripping surfaces for the gripper, expediently prefabricated adapters Ad are firmly screwed to the tool 9 by means of screw bolts Sb (most clearly visible in FIG. 4*a*). Each adapter Ad consists of a fastening part 70, a neck part 71 and a bracket part 72. Since—as is particularly evident from FIG. 1 and the tools in compartment 20—the tools can have different dimensions, to compensate for this either adapters in which the neck parts 71 have different lengths are provided and kept in stock, or the length of the neck part is adjustable, for example by the bracket part 72 being connected to the neck part 71 via a bolt 73 shown by a dashed line, for example a screw bolt, along which length adjustment is possible. In this way, the length of the neck part 71 can be adjusted so that the bracket part 72 (regardless of the width of the tool 9) always reaches the same position. This makes it possible to avoid having to equip the gripper 38 with a complicated sensor control which first has to detect the approach toward the bracket or a gripping surface of the tool in order to control further movement of the gripper.

The gripper 38 can therefore have an extremely simple design and, in the embodiment (FIGS. 3*a* and 4*a*) shown, consists simply of at least one (here two) hooks H arranged in the form of a fork. Thus, if the handling device is brought into use for the first time, the rotary table 66 is brought into a position such that the gripping arm points straight toward the adapter Ad, as shown in FIG. 4*a*. Either the associated motor 60 is in the form of a stepping motor, in which case this position can be approached very precisely but by expensive means, or a cheap, conventional motor 60 is used, in which case it is expedient to provide a lock. This may be effected by a method in which the rotary table 66 possesses a certain degree of rotational movement with respect to the hollow shaft 64 and is finally brought into the correct position by a wedge lock 74 which is actuated, for example, by a piston/cylinder unit 75. Additionally or alternatively, a displacement transducer can be provided for the rotary table, for example the motor 60 being switched off only when the lock 74 has fallen into the associated funnel-shaped (in plan view) recess of the rotary table 66. In this case, the rotary table 66 can be rigidly connected to the hollow shaft 64.

During this swivel operation, the piston 69 assumes its lowest position, so that the hook H occupies the dash-dot position shown in FIG. 3*a* and is swivelled underneath the bracket part 72. As soon as the lock 74 has entered the associated recess of the rotary table 66, pressure medium is admitted under the piston 69 so that the said piston rises until the gripping arm 32 assumes the position shown by solid lines in FIG. 3*a*, the hook H gripping the bracket 72.

The gripping arm 32 rests on the piston rod of piston 69 only under its own weight. There is of course the danger of constant vibration during operation of the press 1, with production of noise and the risk of knocking out the swivel bearing on the axle 68. It is therefore expedient if the gripping arm 32 in its rest position, i.e. during operation of the punch press 1, is clamped to a stationary part. This may be any part of the press, although the gripping arm 32 is preferably clamped directly to the bracket part 72, so that no special means are required. This means that the piston 69 is held in its upper position under pressure during operation of the press. This can be effected either by providing, for the valve controlling the pressure medium feed (not shown), a shunt line to switch S2 for control, or by connecting this valve, when its solenoid is in the non-energized state, so as to connect the pressure medium source 50 to the underneath of the piston 69.

Another problem is that, with a simple gripper 38 of this type, the tool 9 (together with the tool 12 on top)

can only be gripped on one side if expensive constructions for a second point of access are avoided. The tool thus exerts a considerable torque on the gripping arm 32 and especially on the gripper 38 itself.

In order to take up this torque, it is expedient to provide the gripper 38 with at least one supporting surface F, with which it can support itself on a corresponding supporting surface of of the tool, preferably of the adapter. As shown in FIG. 3*a*, the supporting surface F of the gripper 38 is located on its front face, whereas the corresponding supporting surface of on the fastening part 70 of the adapter Ad is located opposite it. If adapters with an adjustable neck part 71 were used, the corresponding supporting surface would either likewise have to be adjustable or connected to the bracket part 72, from which it would have to be separated by an appropriate, predetermined distance in order to be supported on the gripper 38.

If the gripper were not mounted on the press by means of the sliding guide 30 but were standing on its own substructure freely adjacent to the press, which however, in the case of a high-speed press, would be advantageously provided with the supporting springs 14, there would be a degree of uncertainty in gripping the adapter Ad, which could be located higher or lower, depending on the load (for example due to the tool 9). Although relatively expensive gripper designs are known which are capable of finding the particular required position themselves with the aid of sensors, the aim is in fact to simplify the gripper design as far as possible. The locking means 42 is of great interest for such cases too because it ensures a predetermined height when the gripper 38 is intended to grip the adapter Ad.

Of course, although the locking means is preferably operated by means of a fluid, any drive may be used which permits the press and the gripper to be brought to a predetermined height relative to one another, such as motor-driven spindles, wedges, etc.

Figure 2A:
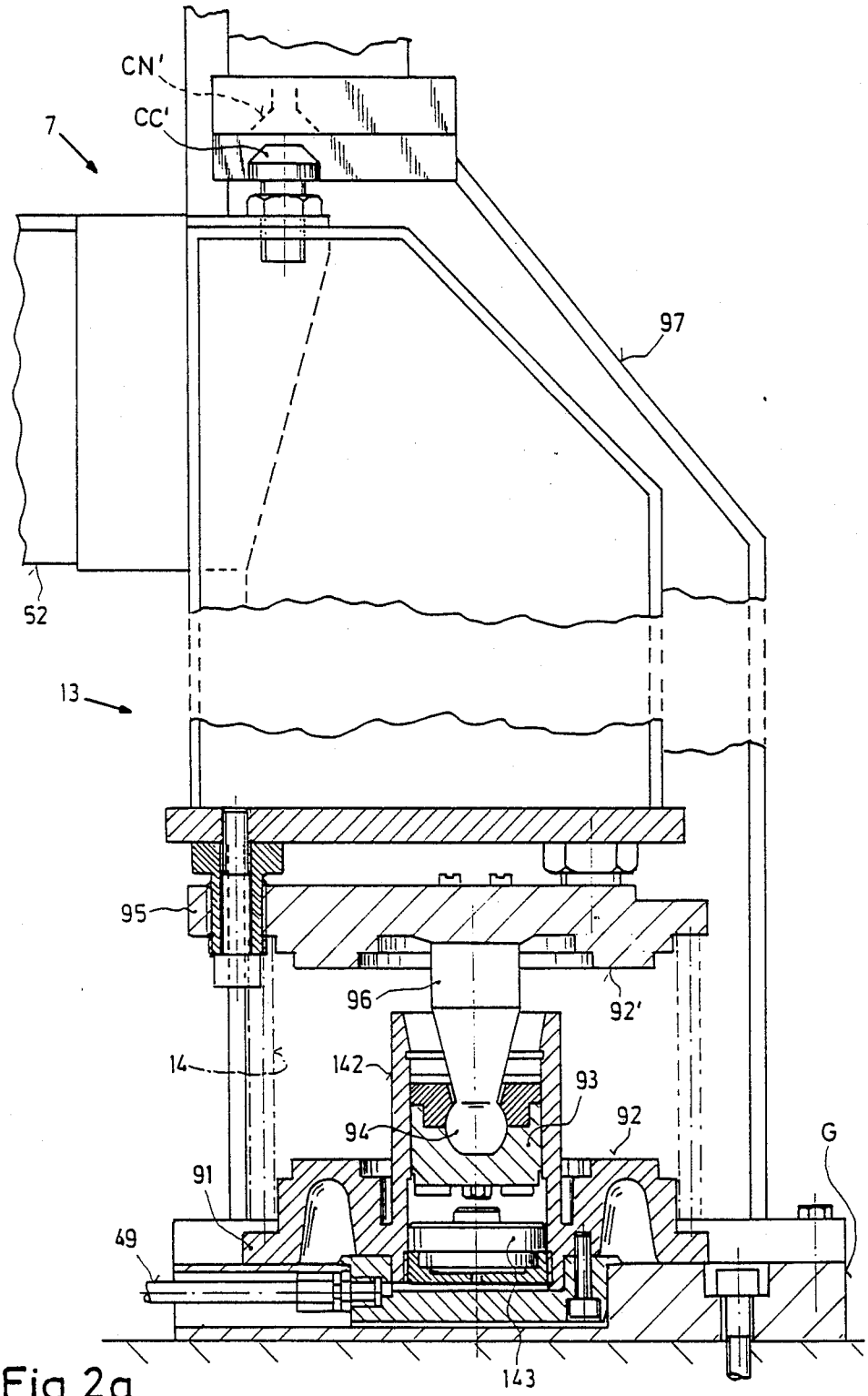
Figure 2B:
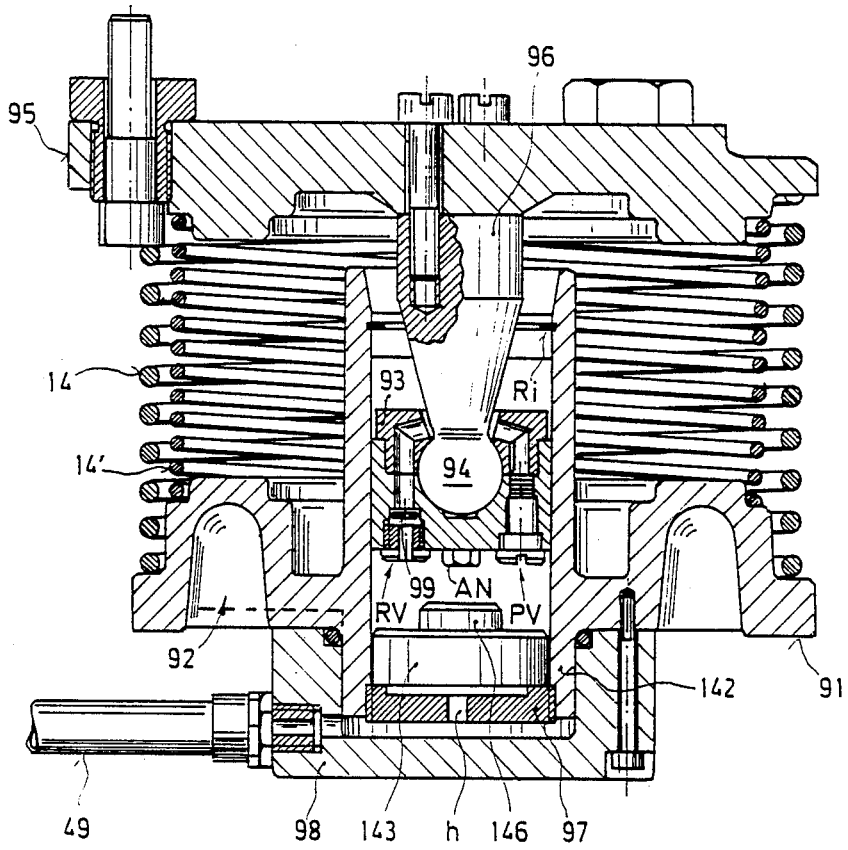
FIG. 2*b* represents a detail on an even larger scale.
Figure 2B:
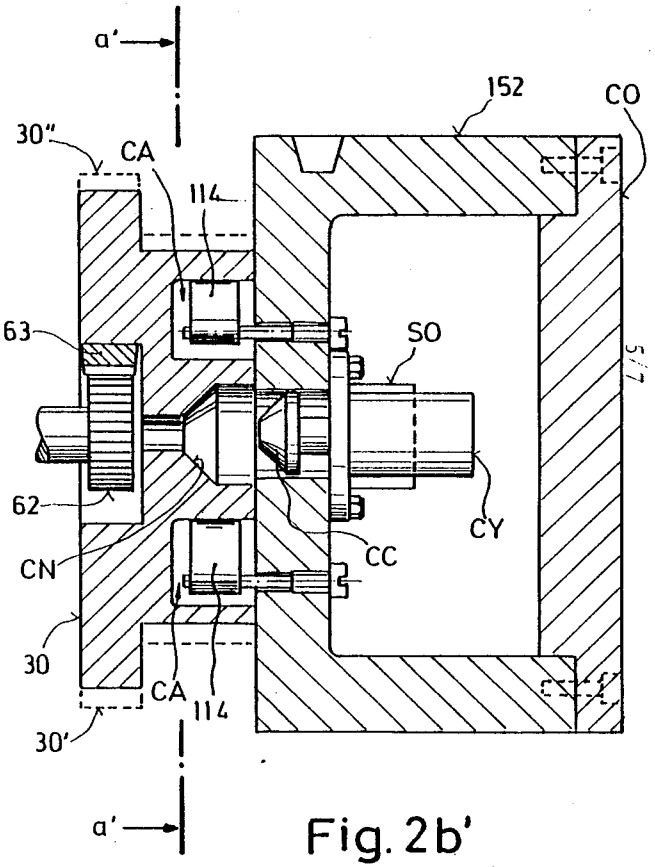
Figure 2A:
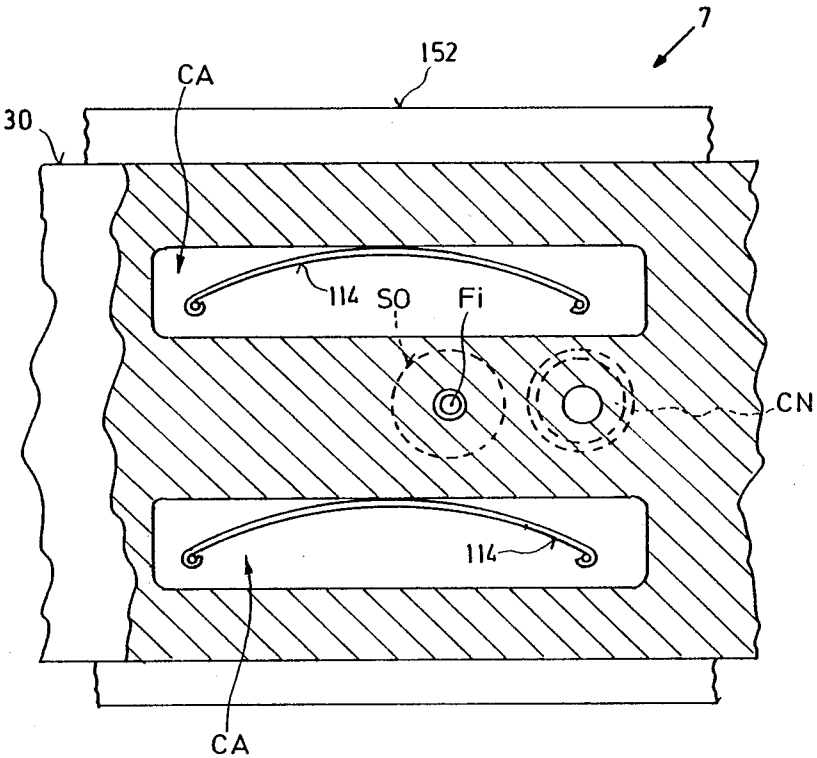

FIG. 2*a* and 2*b* illustrate a particularly advantageous embodiment of such a locking means, which in this case is combined with a damping system. As shown in FIG. 2*b*, in order to improve the stability a double ring of coil springs 14, 14' wound in opposite directions is provided here for supporting each leg 13. The bases of the springs 14, 14' are supported on a shaped plate 91 having a conical ring 92, opposite the top of which is located a conical counter-ring 92'.

This type of spring mounting is shown in detail here merely by way of example and can readily be replaced by equivalent structures, for example by arranging for example four (or more) individual coil springs on the axes of a cross or on the arms of a star, instead of a coil spring surrounding the shaped plate 91.

A cylinder 142 is formed on, or attached to, the shaped plate 91, coaxially with the conical ring 92. The cylinder 142 may be open at the top, as in the present case. Inside the cylinder 142, which is filled with a hydraulic fluid, a damping piston 93 is provided, the said piston being connected to a peg 96 screwed to a supporting plate 95 for the leg 13, via a sphere 94 formed on the said peg (in the form of a ball-and-socket joint). Before describing the damping piston 93 in detail, the remaining structure will first be described.

As shown in FIG. 2*a*, the shaped plate 92 is located on a baseplate G which rests on the floor and from which a fixed substructure 97 projects upward. This baseplate G also contains the line 49 (cf. FIG. 1), and it can also be seen that the cylinder 142 continues downward into a depression in this baseplate G, where it is terminated by an end wall 97, which is more clearly visible in FIG. 2*b*. This end wall 97 may be screwed in (as shown in FIG. 2*b*) or fastened in some other way.

Furthermore, the base of the cylinder 142 is surrounded or closed by a cap 98, which is screwed to the shaped plate 91. The line 49 is connected to this cap 98 in the manner shown in FIG. 2*b* and—when the solenoid valve MV (FIG. 1) is opened—supplies fluid, for example hydraulic fluid, to the interior of the cap 98, from where the said fluid can pass into the cylinder 142 via at least one opening h in the end plate 97.

In the embodiment shown (FIG. 2*b*), the damping piston 93 possesses two holes which lead to its upper end and in which valves RV and PV are arranged. The valve RV is designed as a non-return valve whose valve member, however, is formed by a small plate 99 which has a narrow opening and can be moved up and down in a chamber having a larger diameter. If the damping piston 93 is forced downwards, the fluid present in the cylinder 142 presses the small plate 99 upwards, so that the chamber which holds it is closed, with the exception of the small flow orifice in the small plate 99. Thus, downward impacts, which are inevitable in presses, are greatly damped.

If the damping piston 93 is then intended to travel upwards again, the small plate 99 falls downwards inside its chamber and allows the hydraulic medium accumulated above the piston 93 not only to pass through its small opening but also to run laterally past its circumference through the chamber, so that the upward movement of the piston 93 can take place rapidly. For strong, sudden impacts, it is also possible to provide a pressure relief valve PV in the piston 93, such a valve being shown merely schematically here.

Thus, while the damping described is important for operation of the press, the cylinder 142 provided for this purpose is also used for locking the substructure 7 at a predetermined height. For this purpose, it would be possible to design the valves RV and PV so that they can be blocked, and also to use the damping piston 93 as a piston for the locking means (analogous to the piston 43 of FIG. 1). However, from a design point of view it is simpler to provide a second piston 143 in the cylinder 142, which piston is put under pressure from below when the solenoid valve MV (FIG. 1) is opened, moves upwards and presses, with a projection 146, against the damping piston 93 (expediently against a stop nut AN), in order to force the said damping piston upwards to a predetermined position. The stop nut AN expediently projects slightly beyond the projecting parts of the valves RV and PV, in order to protect them.

It has already been mentioned above that various other operation mechanisms can also be used in place of a drive employing a fluid, and, on consideration of FIG. 2*b*, it is easy to imagine omitting the piston 143, providing the opening h with a thread and passing a screw spindle, for example a motor-driven one, through the said opening, which screw spindle performs the function of the stop projection for pressing upward against the nut AN.

The predetermined position to which the damping piston 93 can be brought can be regulated in two ways. It may be determined by appropriate control of the solenoid valve MV (FIG. 1), since the piston 143 always starts from the initial position shown in FIG. 2*b* and its height therefore depends only on the amount of hydraulic medium fed in, which can easily be regulated via the valve MV. Or, a stop is provided in the cylinder 142 and may be formed, for example, by an inserted ring Ri or, if necessary, by an adjustable stop screw.

It has been mentioned above that the gripper can also be separately elastically mounted. With reference to FIG. *2a', 2b'*, it is intended to show that, in such a case too, a locking means is advantageous for fixing a predetermined relative height of press and gripper. Separate elastic mounting of the gripper is advisable in particular for protecting any electric motors, the bearings of which are often very sensitive to impact.

FIG. *2a'* is a partial view of the sliding guide shown in FIG. 1, and is a partial section along the line a'—a' of FIG. *2b'*. As shown in FIG. *2b'*, the bearing bed 152 is somewhat modified compared with the bearing bed 52 of FIG. *3a* and is provided with a cover CO, so that installations, which will be described later, can be housed.

For elastic mounting of the gripper on the substructure 7, in this case springs 114 are housed in recesses CA of the sliding guide 30. The springs 114 are shown here in the form of simple leaf springs, but several leaf springs may also be provided, and it will furthermore be possible to provide coil springs or the like for support. In any case, this elastic mount results in the sliding guide 30 being displaced downwards to a position 30' under the load, and, in the case of tilting moments (for example when the gripper is at one end of the sliding guide 30), it is also possible for the sliding guide 30 to move upwards at the other end into a position 30''.

However, to simplify the gripper design, it is important in this case too to provide predetermined relative positions of the press and the gripper. Thus, before the gripper is started up, the sliding guide 30 can be locked in a predetermined position by providing it with a conical depression CN, which a centring cone CC can engage for orientation.

At this point, attention should once again be drawn to FIG. *2a*, which shows a similar arrangement having depression CN' and CC', the depression CN' being provided in a plate of the fixed stand 97, and the centring cone CC' being provided on the upper surface of the elastically mounted substructure 7. This arrangement permits dual fixing when the piston 143 travels upwards, the centring cone CC' expediently being adjustable in its height and then being able to act as a stop for the desired predetermined position.

A similar situation applies in the case of FIG. *2b'*, in which, however, it is necessary to provide an actuation drive for the centring cone CC. A cylinder CY, which may be a hydraulic or pneumatic cylinder or is formed by a powerful moving-coil magnet, is provided for this purpose. If it is desired to use the bearing bed 52 without the cover CO, it may be advantageous to reverse the arrangement and to house the depression CN in the bearing bed but the centring cone CC, together with its actuating cylinder CY, on the sliding guide 30. If desired, after the centring cone CC has engaged the depression CN, it is also possible for a locking finger Fi, shown in FIG. *2a'*, to be inserted into an appropriate orifice in the sliding guide 30 by means of a solenoid SO (also see FIG. *2b'*), in order to prevent any slipping. Expediently, of course, several such locking means CC, CN and, if necessary, Fi will be provided along the sliding guide 30, preferably at least two located a distance apart.

As explained, the relevant elastically mounted substructure 7 and/or 30 will be displaced in particular in height, and fixing in a predetermined position is also of particular importance for interaction with the gripper arm 38 of the handling device. It will therefore also be sufficient, for example in the case of the means CC, CN (FIG. *2b*), to replace the centring cone CC by a wedge which centres the height position; however, the cone CC has the advantage of additional lateral centring, so that, for example when a stepping motor is used for the displacement, a predetermined number of step pulses can be provided in order to move the gripper to the position 31''' (FIG. 2), and the light barrier 40, 41 can be dispensed with.

I claim:

1. In a press, for cooperation with a tool handling device:

(a) drive means;

(b) first and second die means movable relatively to each other, at least one of them being driven by said drive means;

(c) frame means including:

a bearing portion bearing the weight of the press, a die support portion for supporting said drive means and said die means, and vertical spring means between said bearing portion and said die support portion for absorbing vibrations resulting from the relative movement of said die means, the spring means thus rendering the die support portion elastically movable in vertical direction relatively to said bearing portion, the spring means having a compressed position in which it is substantially fully compressed so as to exert a maximum force; and (d) locking means for selectively locking said die support portion in a locking position, in which it is at a predetermined level relative to said bearing portion, and in which the spring means is out of said compressed position, wherein said locking means comprise stop means and counter-stop means for determining said predetermined level, said stop means and counter-stop means abutting each other in said locking position.

2. A press as claimed in claim 1, further comprising adjusting means for vertically adjusting said stop means.

3. A press as claimed in claim 1, wherein said locking means comprise actuating drive means.

4. A press as claimed in claim 3, wherein said actuating drive means are of the fluidic type.

5. A press as claimed in claim 4, wherein said actuating drive means comprise means operable by a hydraulic fluid.

6. In a press, for cooperation with a tool handling device:

(a) drive means;

(b) first and second die means movable relatively to each other, at least one of them being driven by said drive means;

(c) frame means including:

a bearing portion bearing the weight of the press, a die support portion for supporting said drive means and said die means, and vertical spring means between said bearing portion and said die support portion for absorbing vibrations resulting from the relative movement of said die means, the spring means thus rendering the die support portion elastically movable in vertical direction relatively to said bearing portion; and (d) locking means for selectively locking said die support portion in a locking position in which it is at a predetermined level relative to said bearing portion, said locking means comprising stop means and counter-stop means for determining said predetermined level, said stop means and counter-stop means abutting each other in said locking position; and further comprising aperture means in one of said portions for receiving said stop means in locking position, said stop means being arranged in the other one of said portions.

7. A press as claimed in claim 6, wherein at least one of said aperture means and said stop means is provided with oblique centering surfaces.

8. In a press, for cooperation with a handling device:

drive means;

first and second die means movable relatively to each other, at least one of them being driven by said drive means;

frame means including:

a bearing portion bearing the weight of the press, a die support portion for supporting said drive means and said die means, and vertical spring means between said bearing portion and said die support portion for absorbing vibrations resulting from the relative movement of said die means, the spring means thus rendering the die support portion elastically movable in vertical direction relatively to said bearing portion;

the press further comprising:

locking means for selectively locking said die support portion relatively to said bearing portion in a locking position at a predetermined level, said locking means comprising actuating drive means surrounded by said spring means.

9. A press as claimed in claim 8, wherein said spring means comprise at least one coil spring surrounding the actuating drive means such that the actuating drive means are centrally located within the coil spring.

10. In a press, for cooperation with a handling device:

drive means;

first and second die means movable relatively to each other, at least one of them being driven by said drive means;

frame means including:

a bearing portion bearing the weight of the press, a die support portion for supporting said drive means and said die means, vertical spring means between said bearing portion and said die support portion for absorbing vibration resulting from the relative movement of said die means, the spring means thus rendering the die support portion elastically movable in vertical direction relatively to said bearing portion, and fluidic damping means for damping the vibrations of said die support portion relatively to said bearing portion;

the press further comprising:

locking means for selectively locking said die support portion relatively to said bearing portion in a locking position at a predetermined level.

11. A press as claimed in claim 10, wherein said locking means comprise fluidic actuating drive means including a piston-cylinder unit and fluid supply means for moving and locking the die support portion in locking position, the die support portion, when unlocked, being damped by said fluid.

12. A press as claimed in claim 11, wherein said piston-cylinder unit is common to said fluidic damping means and said fluidic actuating drive means.

13. A press as claimed in claim 10, wherein said fluidic damping means comprise a non-return valve having an orifice which remains open when said non-return valve closes.

14. A press as claimed in claim 10, wherein said fluidic damping means comprise a pressure relief valve.

* * * * *